US006593850B1

(12) United States Patent
Addy

(10) Patent No.: US 6,593,850 B1
(45) Date of Patent: Jul. 15, 2003

(54) WIRELESS INTRUSION DETECTOR WITH TEST MODE

(75) Inventor: Kenneth L. Addy, Massapequa, NY (US)

(73) Assignee: Pittway Corp., Chicago, IL (US)

( * ) Notice: Subject to any disclaimer, the term of this patent is extended or adjusted under 35 U.S.C. 154(b) by 0 days.

(21) Appl. No.: 09/492,993

(22) Filed: Jan. 27, 2000

(51) Int. Cl.[7] ..... G08B 23/00

(52) U.S. Cl. ..... 340/501; 340/506; 340/3.1; 340/507; 340/514

(58) Field of Search ..... 340/501, 506, 340/507, 514, 511, 521, 522, 545.3, 552, 566, 517, 3.1

(56) References Cited

U.S. PATENT DOCUMENTS

| | | | | |
|---|---|---|---|---|
| 4,412,211 A | | 10/1983 | Lautzenheiser et al. | |
| 4,468,657 A | * | 8/1984 | Rossin | 340/555 |
| 4,625,199 A | * | 11/1986 | Pantus | 340/429 |
| 4,725,818 A | | 2/1988 | Motyka et al. | |
| 4,743,886 A | | 5/1988 | Steiner et al. | |
| 4,808,972 A | * | 2/1989 | Nicholls | 340/541 |
| 4,845,464 A | * | 7/1989 | Drori et al. | 340/429 |
| 4,862,141 A | * | 8/1989 | Jordal | 340/521 |
| 4,897,630 A | * | 1/1990 | Nykerk | 340/426 |
| 5,083,106 A | | 1/1992 | Kostusiak et al. | |
| 5,414,409 A | * | 5/1995 | Voosen et al. | 340/541 |
| 5,499,012 A | * | 3/1996 | Tracey et al. | 340/514 |
| 5,524,099 A | * | 6/1996 | Rickman et al. | 367/13 |
| 5,640,142 A | | 6/1997 | Matatall, Jr. et al. | |
| 5,686,885 A | | 11/1997 | Bergman | |
| 5,877,683 A | | 3/1999 | Sheasley | |
| 5,880,954 A | * | 3/1999 | Thomson et al. | 700/79 |
| 5,898,368 A | * | 4/1999 | Handley et al. | 340/514 |
| 5,907,279 A | | 5/1999 | Bruins et al. | |

* cited by examiner

*Primary Examiner*—Daryl Pope
(74) *Attorney, Agent, or Firm*—Anthony R. Barkume, P.C.

(57) ABSTRACT

A wireless intrusion detector that contains a test mode that temporarily overrides the normal inhibit function of the wireless intrusion detector allowing all alarm messages to be transmitted. Wherein the inhibit function lets a single detected event signal to be transmitted upon the detection of an alarm event and inhibits subsequent transmissions during a predetermined inhibit period. The test mode, usually entered after installation of the intrusion detector, is automatically entered when the case of the intrusion detector is closed and is automatically exited when a predetermined number of detected events have been detected by the detector. The duration of the test mode is dependent on the detection of motion a predetermined number of times rather than a predetermined time duration. This allows the installer to perform a complex and time consuming walk test without having to open and close the detector case a number of times. The intrusion detector comprises detector means, counter means, transmitter means, and processing means. The detector means includes PIR motion detectors.

9 Claims, 2 Drawing Sheets

1

1

WIRELESS INTRUSION DETECTOR WITH TEST MODE

BACKGROUND OF THE INVENTION

This invention relates to wireless intrusion detectors adapted to operate with an inhibit mode, wherein a detected event signal is transmitted on the detection of an initial alarm event and inhibited for subsequent alarm events for a predetermined time period; and in particular to wireless intrusion detectors that have a test mode that allows detected event signals to be transmitted for both initial and subsequent alarm events, thereby overriding the normal inhibit mode.

A recent innovation in security applications is the use of wireless detectors, which are small battery powered sensor devices that transmit information back to a central control unit. Wireless detectors are comprised of a sensor that senses an intruder in its field of view, typically by detecting motion, and a transmitter that transmits the sensor identification code to the central control unit. The central control unit receives the sensor identification code and raises an alarm for the identified zone (the location of the sensor). The major advantage of wireless detectors is that they require less installation time since the detectors do not require wiring back to a control panel.

In alarm systems that use wireless detectors, the life of the detector battery is an important concern. This concern is amplified for detectors located in high traffic areas, such as a hallway. When the alarm system is unarmed and occupants of the premises are moving through the detector's field of view, the detector is continuously transmitting information to the central control unit, which greatly diminishes battery life. In order to overcome this problem, wireless detectors typically include an inhibit circuit which prevents the detector from transmitting to the central control unit more often than once every three minutes, regardless of the motion in the field of view. An example of a wireless detector that uses this inhibit circuit is ADEMCO's 5890 detector.

Although-the three-minute-inhibit circuit saves battery life, it makes installation check out more difficult for the installer. The installation check out or the "walk test" is typically performed directly after installation of the detectors to check that the coverage of the motion detectors is correct, i.e. no unprotected areas, and that the radio path back to the central control unit is adequate. The installer walks though the premises and checks that the central control unit raises an alarm that corresponds to the detection of motion by the appropriate detector. In order to override the three-minute-inhibit circuit to make the walk test more convenient, the installers have traditionally moved a shorting-jumper on the printed circuit board (PCB) to a test position and returned it to its normal position following the walk test. Since the detectors are usually mounted high in a room, this method is time consuming and inconvenient. It is also possible that the installer may damage the PCB while moving the jumpers, to and from the test position.

A recent innovation for overriding the three-minute-inhibit circuit is the use of a timer circuit that is initiated when the plastic case of the detector is snapped closed. The timer circuit counts a fixed time during which the three-minute-inhibit mode is suspended allowing the detector to transmit an ID code for all motion detected. An example of a detector incorporating a timer circuit such as this, is ADEMCO/Sentrol's AP540W. Detectors of this type allow the installer a fixed time period to perform the walk test for each detector, after which the detector reverts to its normal three-minute-inhibit mode. This latter method is not an ideal solution because there are times when the installer may be distracted, or the walk test may be complex and time consuming, whereby the detector reverts back to its normal three-minute-inhibit mode before the installer is finished with the walk through test. When this occurs, it is necessary for the installer to restart the timer by opening and closing the detector case.

It is therefore an object of the present invention to provide a wireless intrusion detector that contains a test mode during which all detected event signals are transmitted.

It is a further object of the present invention to provide a wireless intrusion detector with a test mode that is independent of time.

It is a further object of the present invention to provide a wireless intrusion detector with a test mode that is activated automatically without requiring adjustment of jumpers or switches.

It is still a further object of the present invention to provide a wireless intrusion detector with a test mode that reverts back to its normal inhibit mode automatically.

SUMMARY OF THE INVENTION

In accordance with these and other objects, the present invention is a wireless intrusion detector that contains a test mode that temporarily overrides the normal inhibit function of the wireless intrusion detector allowing all alarm messages to be transmitted. The inhibit function lets a single detected event signal to be transmitted upon the detection of an alarm event and inhibits subsequent transmissions during a predetermined inhibit period. The test mode, usually entered after installation of the intrusion detector, although may be entered any time the case of the intrusion detector is opened and closed, is not time dependent as in the prior art. Instead, the test mode is automatically entered when the case of the intrusion detector is closed and is automatically exited when a predetermined number of detected events have been detected by the detector. The predetermined number of detected events is selected during manufacture to allow the installer to more than adequately perform the walk test. Since the test mode is not dependent on time, the installer can perform a complex and time consuming walk test without having to open and close the detector case a number of times. Upon completion of the walk test by the installer, the detector returns to normal inhibit mode when the number of detected events is equal to the predetermined number programmed into the detector at the factory, which is typically 64. If the walk test is completed prior to the detection of motion 64 times, the detector will send all detected event signals for a short period of time. The extra transmissions will only use a small amount of battery life.

The intrusion detector comprises detector means for detection, counter means for counting, transmitter means for transmitting, and processing means for processing. The detector means includes PIR motion detectors and any other detectors that contain an inhibit mode used for limiting the transmissions from the detector to a central processor. The counter means, the crux of the present invention, consists of a counter circuit that may be internal or external to the processing means. The counter means is reset by the processing means when the test mode is entered, and is incremented upon detection of each alarm event. The processing means, which is comprised of a microprocessor or ASIC and its associated circuits such as memory circuits, decoding circuits, control circuits, and timer circuits, reads the counter means each time an alarm event has been detected to determine if the test mode should be exited. The processing means controls the transmitter means to transmit a detected event signal to the central control unit upon the detection of each alarm event during the test mode, or after the completion of an inhibit time period and the detection of an alarm event during the normal inhibit mode. The transmission means is typically an RF transmitter but may also be an optical transmitter.

The wireless intrusion detector further comprises a tamper switch for initiating the test mode. The tamper switch is activated by the closing of the detector case. The state of the tamper switch is monitored by the processing means.

The method of the present invention comprises the steps of detecting an alarm event and generating a detected event signal, incrementing a counter with the detected event signal to generate a detected event count, comparing the detected event count to a predetermined count, transmitting the detected event signal if the detected event count is less than the predetermined count, and exiting the test mode when the detected event count is not less than the predetermined count whereby the inhibit function is resumed. The method further comprises the steps of installing a detector for detecting an alarm event and initiating the counter to zero prior to the step of detecting an alarm event.

DETAILED DESCRIPTION OF THE PREFERRED EMBODIMENT

Figure 1:
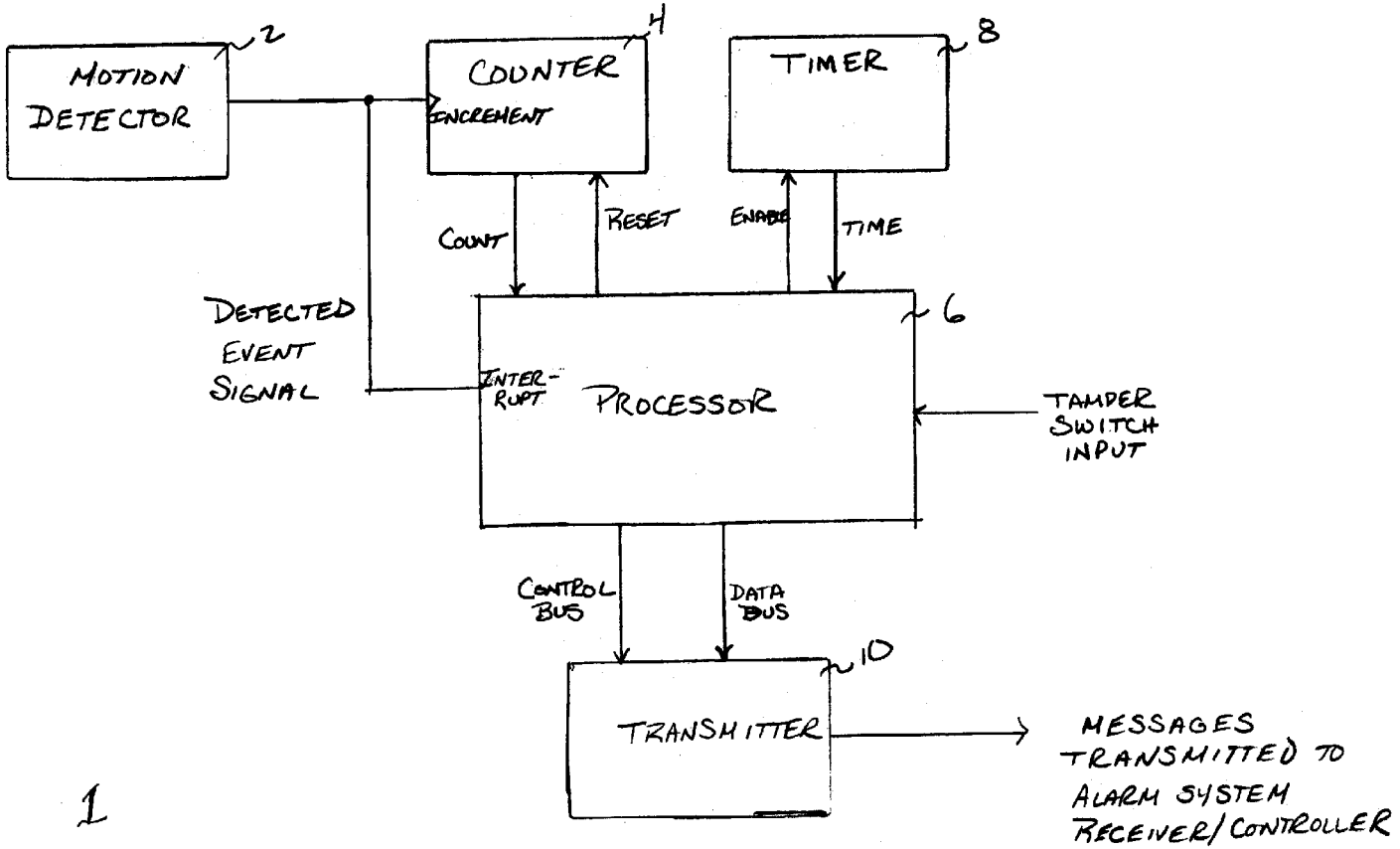
FIG. 1 is a block diagram of the present invention.

Shown in FIG. 1 is a functional block diagram of the preferred embodiment of an intrusion detector 1 comprising a motion detector 2, a counter 4, a timer 8, a processor 6, and a transmitter 10. The intrusion detector 1 is installed in a location where it can effectively detect an intruder, as well known to one skilled in the art. After installation, the installer typically performs a walk test to check the coverage of the detector and the interface between the detector and the receiver/controller, also known to one skilled in the art. The intrusion detector 1 of the present invention allows the installer to perform the walk test without adjustments of switches or jumpers. The intrusion detector 1 enters a test mode, specifically for performing the walk test, by closing the case of the intrusion detector 1, thereby activating a tamper switch that causes the processor 6 to initiate the test mode. Once the processor 6 is in the test mode it resets the counter 4 and waits for the motion detector 2 to detect motion. Rather than counting the elapsed time in order to determine when to exit the test mode, as in the prior art, the processor 6 counts the number of times the motion detector 2 detects motion. As shown in FIG. 1 the motion detector 2 produces a detected event signal that causes the counter 4 to increment and the processor 6 to be interrupted. The processor 6 reads the count from the counter 4 and if the count is below 64, a detected event message is transmitted which is comprised of a fault message and a subsequent restore message. The restore message is transmitted when the detected event signal is deactivated. If the count is 64 or more, the processor 6 automatically exits the test mode and starts the normal inhibit mode, by enabling timer 8. In the normal inhibit mode, the processor 6 reads the time from timer 8 each time the detected event signal is activated to determine if the elapsed time from the prior detected event signal is greater than three minutes. If it is not greater than three minutes, the processor 6 will not transmit a fault message. If it is greater than three minutes, the fault message will be transmitted and the timer 8 will be reset.

The test mode allows the installer to perform the walk test without the inhibit mode. The inhibit mode would force the installer to wait three minutes each time he tried to raise a flag (cause an alarm event) in the zone being tested. The test mode allows the installer to perform the walk test much more efficiently. The present invention further enhances the test mode efficiency by automatically entering and exiting the test mode and by maintaining the test mode until motion has been detected 64 times. This allows the installer to perform a complicated walk test without the test mode being exited before the walk test is complete. This also allows the installer to continue the walk test if he was interrupted or distracted while performing the walk test. The detection of motion 64 times has been selected as the best mode of the present invention, although this number may be selected as any number that allows the installer to sufficiently test the coverage of the intrusion detector 1, and that allows the intrusion detector 1 to eventually go back into inhibit or battery saving mode.

Figure 2:
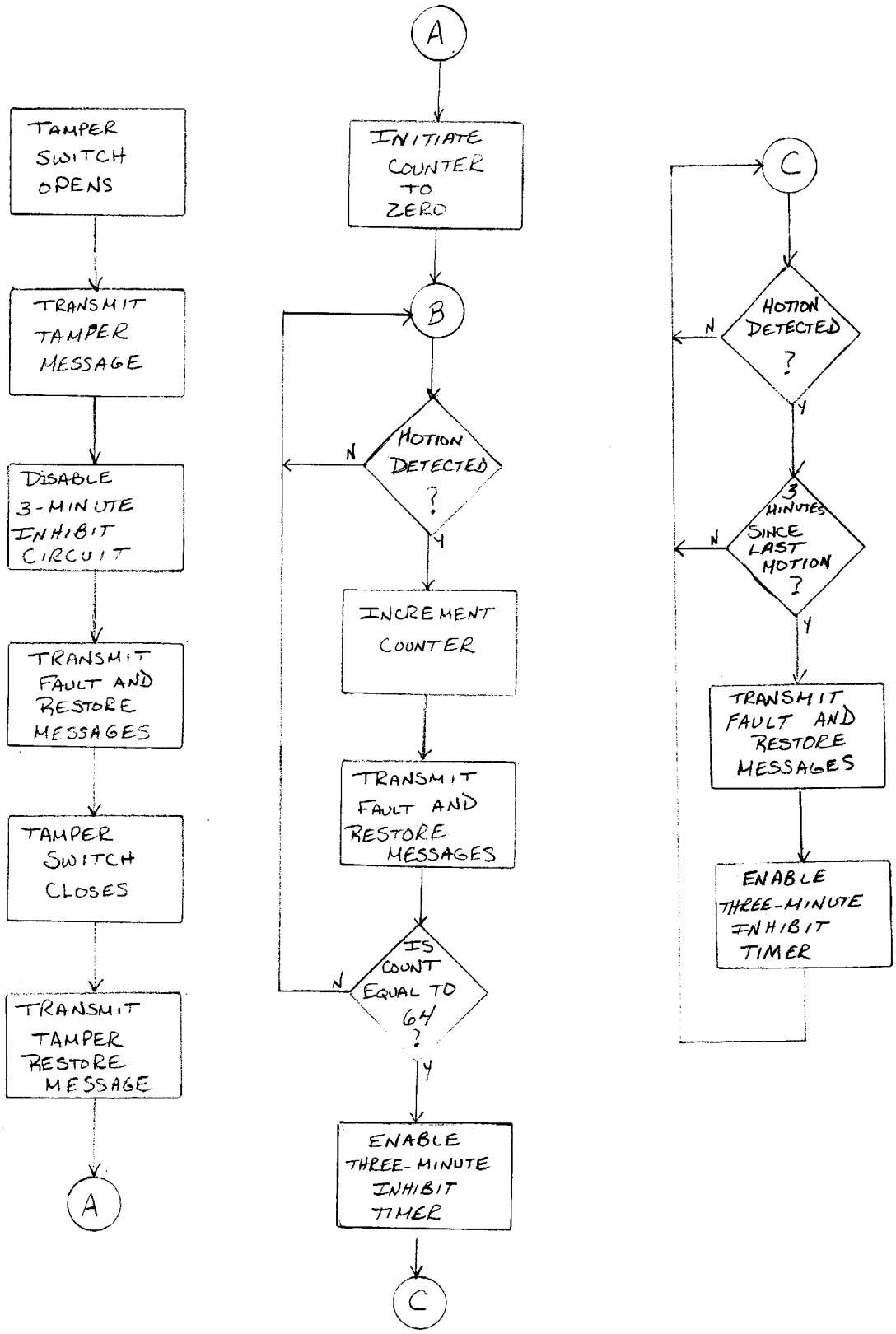
FIG. 2 is a flow diagram of the intrusion detector operation for installation, test mode, and inhibit mode.

Shown in FIG. 2 is a flow diagram of the intrusion detector operation for installation, test mode, and inhibit mode. Upon installation of a wireless motion detector 2, the detector case is opened causing the tamper switch to open. The transmitter 10 transmits a tamper message to the receiver/control unit and the processor 6 disables the timer 8. As the motion detector 2 detects motion, the transmitter transmits fault and restore messages, wherein the fault message is transmitted when motion has been detected and the restore message is transmitted when motion has ceased. The detector case is then closed by the installer causing the tamper switch to close, the tamper restore message to be transmitted, and the test mode to be entered.

The test mode is initiated by the processor 6 resetting the counter 4 and waiting for motion to be detected. When the motion is detected (the detected event signal is activated), the counter 4 is incremented and the fault and restore messages are transmitted. The processor 6 then reads the count and determines if it is equal to 64. If it is not, the processor 6 continues to wait for motion events to be detected. If the count is equal to 64, the processor 6 enters the inhibit mode by enabling the timer 8 and waiting for motion to be detected. Once motion is detected, the processor 6 reads the time from timer 8 and determines if it is greater than three minutes. If it is not, the processor 6 continues to wait for motion. If it is greater than three minutes, the transmitter 10 transmits the fault and restore messages and the timer 8 is reset and enabled.

It will be apparent to those skilled in the art that modifications to the specific embodiments described herein may be made while still being within the spirit and scope of the present invention. For example, the count of 64 may be selectable or adjusted, and the inhibit mode may inhibit transmission for more or less than three minutes. Also the initiation of the counter 4 to zero and the enabling of the three-minute-inhibit timer 8 may be performed by other methods commonly used by one skilled in the art.

I claim:

1. In an alarm system comprising an intrusion detector adapted to operate with an inhibit function to transmit a detected event signal on the detection of an initial alarm event and to inhibit subsequent transmissions during a predetermined inhibit period, the intrusion detector comprising:

a) detector means for detecting an alarm event and generating a detected event signal;

b) counter means which is incremented by the detected event signal to generate a detected event count;

c) transmitter means for transmitting the detected event signal if the detected event count is less than the predetermined count; and d) processing means for temporarily overriding the inhibit function of the intrusion detector during a test mode and for exiting the test mode when the detected event count is not less than the predetermined count whereby the inhibit function is resumed.

2. The device of claim 1 further comprising a tamper switch for initiating a test mode and for initiating the counter to zero.

3. The device of claim 1 wherein the detector means is a motion detector.

4. The device of claim 1 wherein the predetermined count is 64.

5. In an alarm system comprising an intrusion detector adapted to operate with an inhibit function to transmit a detected event signal on the detection of an initial alarm event and to inhibit subsequent transmissions during a predetermined inhibit period, a method of temporarily overriding the inhibit function of the intrusion detector during a test mode comprising the steps of:

a) detecting an alarm event and generating a detected event signal;

b) incrementing a counter with the detected event signal to generate a detected event count;

c) comparing the detected event count to a predetermined count;

d) transmitting the detected event signal if the detected event count is less than the predetermined count; and e) exiting the test mode when the detected event count is not less than the predetermined count whereby the inhibit function is resumed.

6. The method of claim 5 further comprising the step of initiating the counter to zero prior to the step of detecting an alarm event.

7. The method of claim 6 further comprising the steps of installing a detector for detecting an alarm event prior to the step of initiating the counter to zero.

8. The method of claim 5 wherein the step of detecting an alarm event is performed by a motion detector.

9. The method of claim 5 wherein the predetermined count is 64.

* * * * *